US007826633B2

(12) United States Patent
Davi

(10) Patent No.: US 7,826,633 B2
(45) Date of Patent: Nov. 2, 2010

(54) SPEAKER COVER

(75) Inventor: Leonard A. Davi, Longwood, FL (US)

(73) Assignee: Audiovox Corporation, Hauppauge, NY (US)

( * ) Notice: Subject to any disclaimer, the term of this patent is extended or adjusted under 35 U.S.C. 154(b) by 1099 days.

(21) Appl. No.: 11/188,920

(22) Filed: Jul. 25, 2005

(65) Prior Publication Data

US 2007/0036369 A1 Feb. 15, 2007

(51) Int. Cl.
*H04R 1/20* (2006.01)

(52) U.S. Cl. ..... 381/345; 381/333; 381/335; 381/386

(58) Field of Classification Search ..... 181/199, 181/149; 312/204; 381/345, 351, 388, 333, 381/87; D14/204, 207, 221; 379/430
See application file for complete search history.

(56) References Cited

U.S. PATENT DOCUMENTS

| | | | | | |
|---|---|---|---|---|---|
| 2,969,848 | A | * | 1/1961 | Farwell | 181/145 |
| 3,818,138 | A | * | 6/1974 | Sperrazza, Jr. | 381/336 |
| 4,063,387 | A | * | 12/1977 | Mitchell | 47/67 |
| 4,169,516 | A | * | 10/1979 | Honda | 181/153 |
| 4,356,881 | A | | 11/1982 | Lowell | |
| 4,754,852 | A | * | 7/1988 | Mule et al. | 181/149 |
| 4,875,143 | A | | 10/1989 | Fernandez | |
| 4,923,033 | A | | 5/1990 | Panick et al. | |
| 4,926,962 | A | | 5/1990 | Graham et al. | 181/150 |
| 4,936,410 | A | | 6/1990 | Howell | |
| 5,322,979 | A | | 6/1994 | Cassity et al. | |
| 5,403,080 | A | * | 4/1995 | Thee | 312/204 |
| 5,444,194 | A | * | 8/1995 | Reinke | 181/150 |
| 5,995,634 | A | * | 11/1999 | Zwolski | 381/160 |
| 6,056,083 | A | * | 5/2000 | Daniell | 181/199 |
| 6,142,254 | A | | 11/2000 | Claybaugh et al. | 181/199 |
| 6,321,871 | B1 | | 11/2001 | Russell | |
| D467,896 | S | | 12/2002 | Myers | D14/207 |
| 6,658,131 | B2 | * | 12/2003 | Smith | 381/386 |
| 6,807,284 | B2 | * | 10/2004 | Nakamura | 381/423 |
| 7,218,747 | B2 | * | 5/2007 | Huffman | 381/345 |
| 7,388,963 | B2 | * | 6/2008 | Han et al. | 381/397 |
| 2008/0226096 | A1 | * | 9/2008 | Waddell et al. | 381/87 |
| 2008/0236452 | A1 | * | 10/2008 | Pratt et al. | 108/13 |

FOREIGN PATENT DOCUMENTS

| | | | |
|---|---|---|---|
| WO | WO 94/12002 | * | 5/1994 |
| WO | WO2005/056142 | A1 | 6/2005 |

OTHER PUBLICATIONS

OutDoor Audio, Sonance®, The Leader in Architectural Audio™, © 2002.

* cited by examiner

*Primary Examiner*—Curtis Kuntz
*Assistant Examiner*—Ryan Robinson
(74) *Attorney, Agent, or Firm*—F. Chau & Associates, LLC

(57) ABSTRACT

A cover for a speaker device having a sound producing portion and a structure for supporting the sound producing portion, the cover includes an opening and an internal cavity therein for receiving and enclosing the speaker device, a first portion capable of passing produced sound therethrough, wherein the first portion is formed to be disposed opposite the sound producing portion of the speaker device.

14 Claims, 9 Drawing Sheets

(a)

(b)

(c)

SPEAKER COVER

BACKGROUND OF THE INVENTION

1. Technical Field

The present disclosure relates generally to a speaker cover, and more particularly, to a removable speaker cover having aesthetic qualities and fitting over or around a speaker device.

2. Discussion of Related Art

For purposes of this disclosure, a speaker or speaker device is defined as a sound producing device including, for example, a driver (e.g., a diaphragm and transducer) housed in an enclosure such as speaker cabinet, an enclosure-less driver, an electrostatic plate or any other device used or sold for the purpose of producing sound such as music, voices and the like. Enclosure-less drivers and electrostatic plates may be mounted to support frames so as to be capable of freestanding on a surface, such as a floor, shelf or desk.

Speakers are often components of entertainment systems such as stereos, multi-media systems, and computers. Speakers can be used indoors or outdoors, and are made to fit in a particular space such as, for example, a floor, a wall, a bookshelf, or a garden. Due to limited numbers of conventional shapes of speaker devices, such as, cubes or spheres, the speaker devices often do not blend with an existing decor. Conventional speakers and cabinets can stand out from the existing décor and may be visually unpleasant.

Speakers with different colors or designs which blend into the environment such as a rock speaker and a planter speaker are available on the market. However, surrounding shells designed in the shape of a rock or a planter to blend with an existing landscape are not replaceable with a different style cover.

SUMMARY OF THE INVENTION

A removable decorative speaker cover enables a speaker to blend with an existing decor. Since the decorative speaker cover is removable from the speaker, the look of the speaker can be changed. Thus, a multitude of decorative options for a single speaker are available with a removable decorative speaker cover.

In an exemplary embodiment of the present invention, a cover is for a speaker device having a sound producing portion and a structure for supporting the sound producing portion. The cover includes an opening and an internal cavity for receiving and enclosing the speaker device, and a first portion capable of passing produced sound therethrough, wherein the first portion is formed to be disposed opposite the sound producing portion of the speaker device.

The first portion may be acoustically transparent or acoustically modifying. The structure may be a speaker cabinet or a support frame. The cover may further include a second portion comprising a soundproofing material and a sound dampening material. The first portion may include at least one opening, cloth, a grill, perforations, acoustic foam and/or venting.

The cover may further include an edge portion for engaging a groove in the structure, such as, for example, in the case of attaching the cover to a wall mounted speaker. Further, the cover may include one or more holes formed in the cover for receiving fixing devices for attaching the cover to a surface, such as, for example, a wall.

The speaker device may be a subwoofer, a woofer, a full-range, a mid-range, a tweeter or a combination thereof.

The cover may be shaped as a vase, a chest, a trunk, a wall sconce, a box, a column, an urn, a bookend, a faux book, a clock, a candle holder, or a planter. The cover may also include a light fixture and/or a storage unit.

In another exemplary embodiment of the present invention, a cover is for a speaker device having a sound producing portion and a cabinet for housing the sound producing portion. The cover includes an opening and an internal cavity for receiving and enclosing the speaker device, and a first portion capable of passing produced sound therethrough.

In another exemplary embodiment of the present invention, a cover is for a speaker device having a sound producing portion and a structure for supporting the sound producing portion. The cover includes an opening and an internal cavity for receiving and enclosing the speaker device, wherein the opening is formed on a bottom side of the cover, and a spacer formed on the bottom side of the cover for spacing the bottom side of the cover from a surface on which the cover rests, whereby the produced sound projects through the opening.

BRIEF DESCRIPTION OF THE DRAWINGS

These and other features of the present invention may be better and more completely understood by studying the following detailed description of exemplary embodiments together with the drawings, of which.

DETAILED DESCRIPTION OF EXEMPLARY EMBODIMENTS

Exemplary embodiments of the present invention will now be described more fully with reference to the accompanying drawings. This disclosure may, however, be embodied in many different forms and should not be construed as being limited to the embodiments set forth herein. Rather, these embodiments are provided so that this disclosure will be thorough and complete, and will fully convey the concept of the invention to those skilled in the art.

Figure 1A:
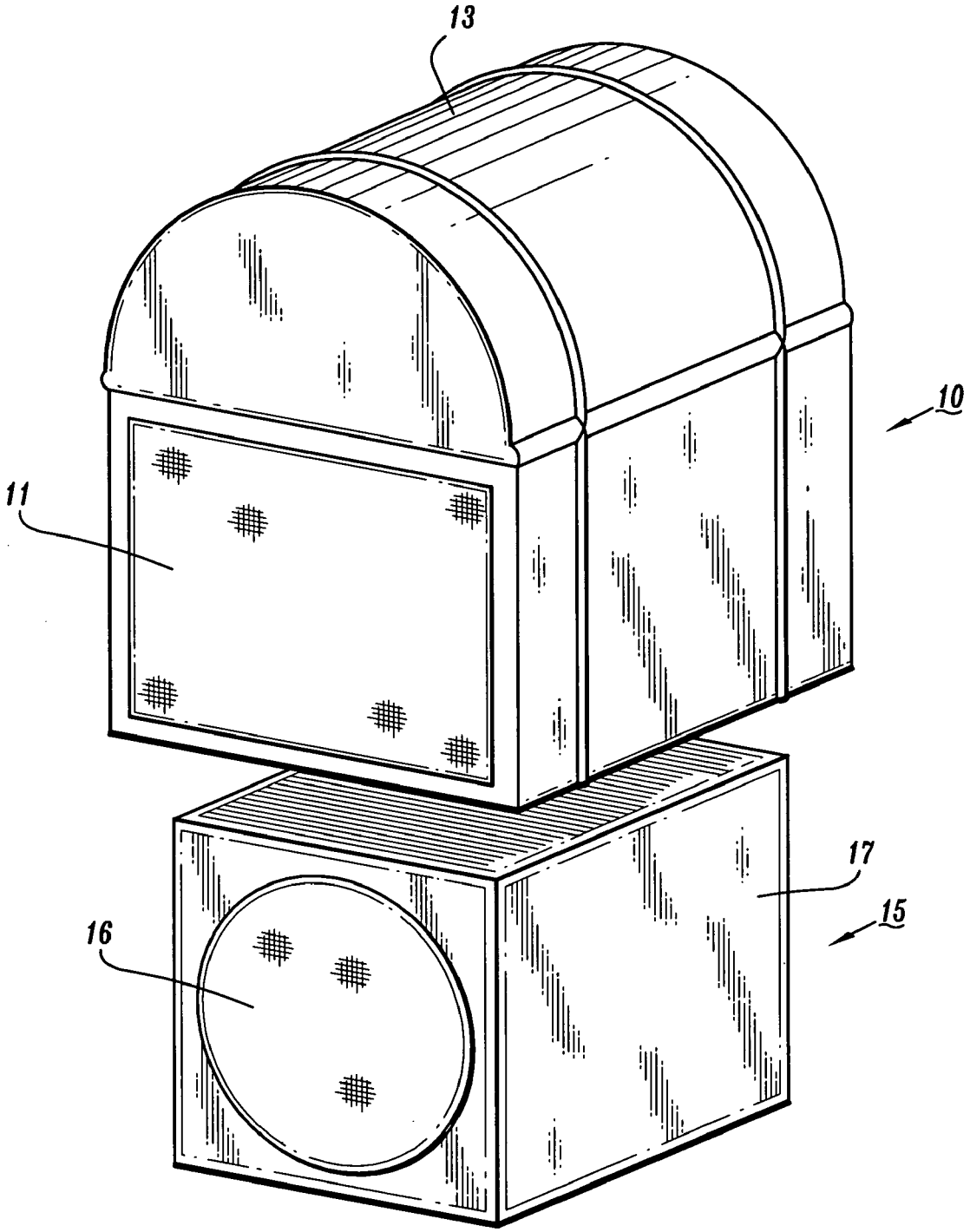
FIG. 1A shows a removable speaker cover according to an exemplary embodiment of the present invention.

FIG. 1A shows a perspective view of a removable speaker cover 10 shaped as a chest according to an exemplary embodiment of the present invention. The cover 10 comprises four sides and a top portion 13. The top portion 13 of the cover is shaped as an arch. Alternatively, the top portion 13 may be any decorative shape. The bottom portion of the cover 10 comprises a rectangular shape and is open to allow a speaker 15 to enter the cover 10. The cover 10 further includes an internal cavity for receiving and enclosing the speaker 15. The internal cavity is large enough so that the cover 10 rests on the same surface as the speaker 15 when the cover 10 is placed over the speaker 15. The surface may be any flat surface such as, for example, a floor, a shelf or a base portion that rests on the surface in between the cover and the surface.

The speaker 15 comprises a sound producing portion 16 disposed in a housing 17. The sound producing portion 16 includes, for example, a diaphragm and a transducer for projecting acoustic signals. When the housing 17 of the speaker 15 is placed in the cover 10, the housing 17 is covered by the cover 10.

In exemplary embodiments of the present invention, the speaker 15 can be, for example, a bookshelf style speaker or a floorstanding style speaker. The speaker 15 can also be, for example, any of subwoofer, woofer, full-range, midrange, and tweeter types or combinations thereof.

The cover 10 preferably comprises a structure and materials having acoustical transparency and resistance to mechanical vibration or resonation that can be caused by the speaker 15. For the acoustical transparency, a side of the cover 10 may comprise an acoustically transparent portion 11 that is positioned opposite the sound producing portion 16 when the cover 10 covers the speaker 15. Acoustic signals can pass through the acoustically transparent portion 11 of the cover 10 without significant reduction of sound propagation.

Figure 1B:
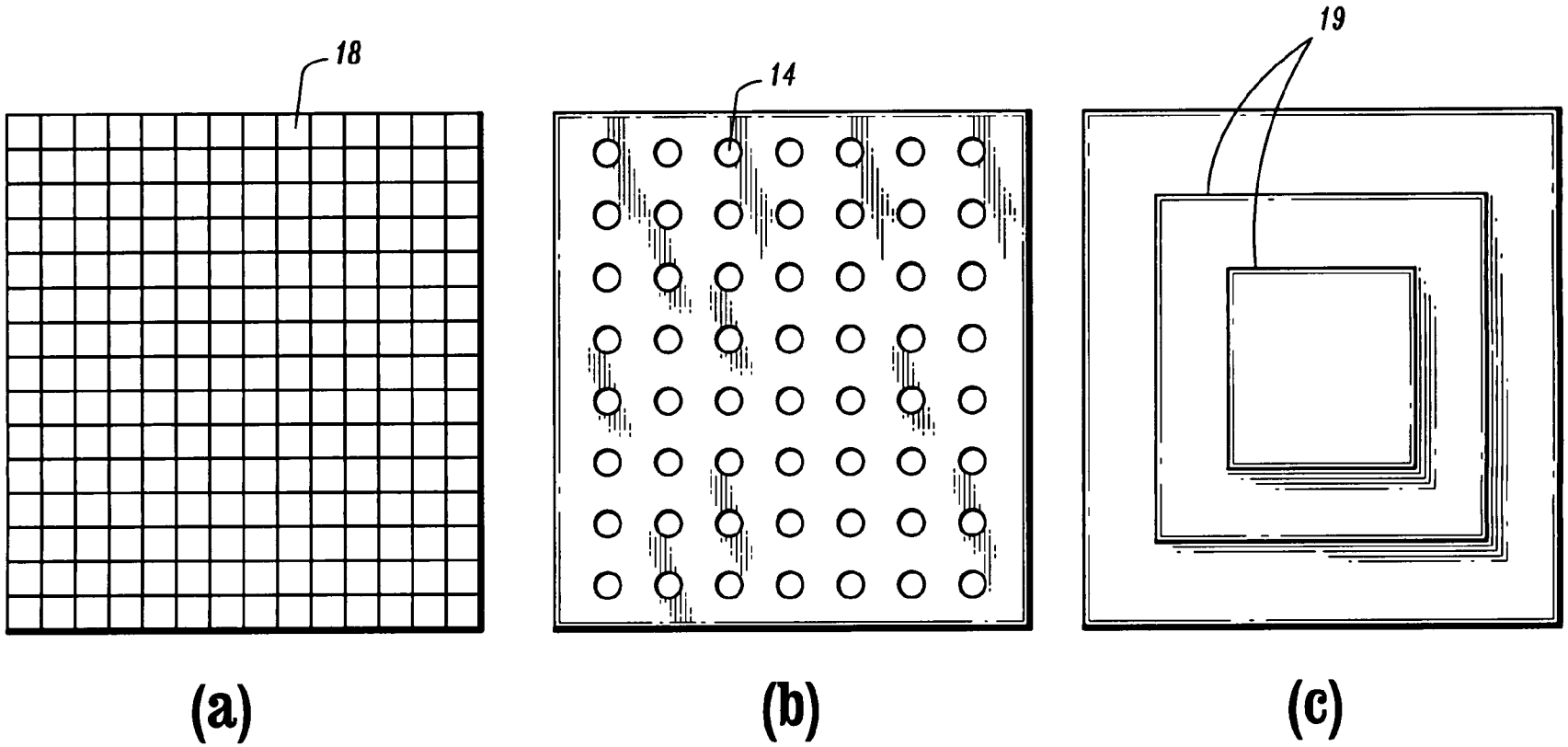
FIG. 1B shows an acoustically transparent portion according to an embodiment of the present invention.
Figure 1C:
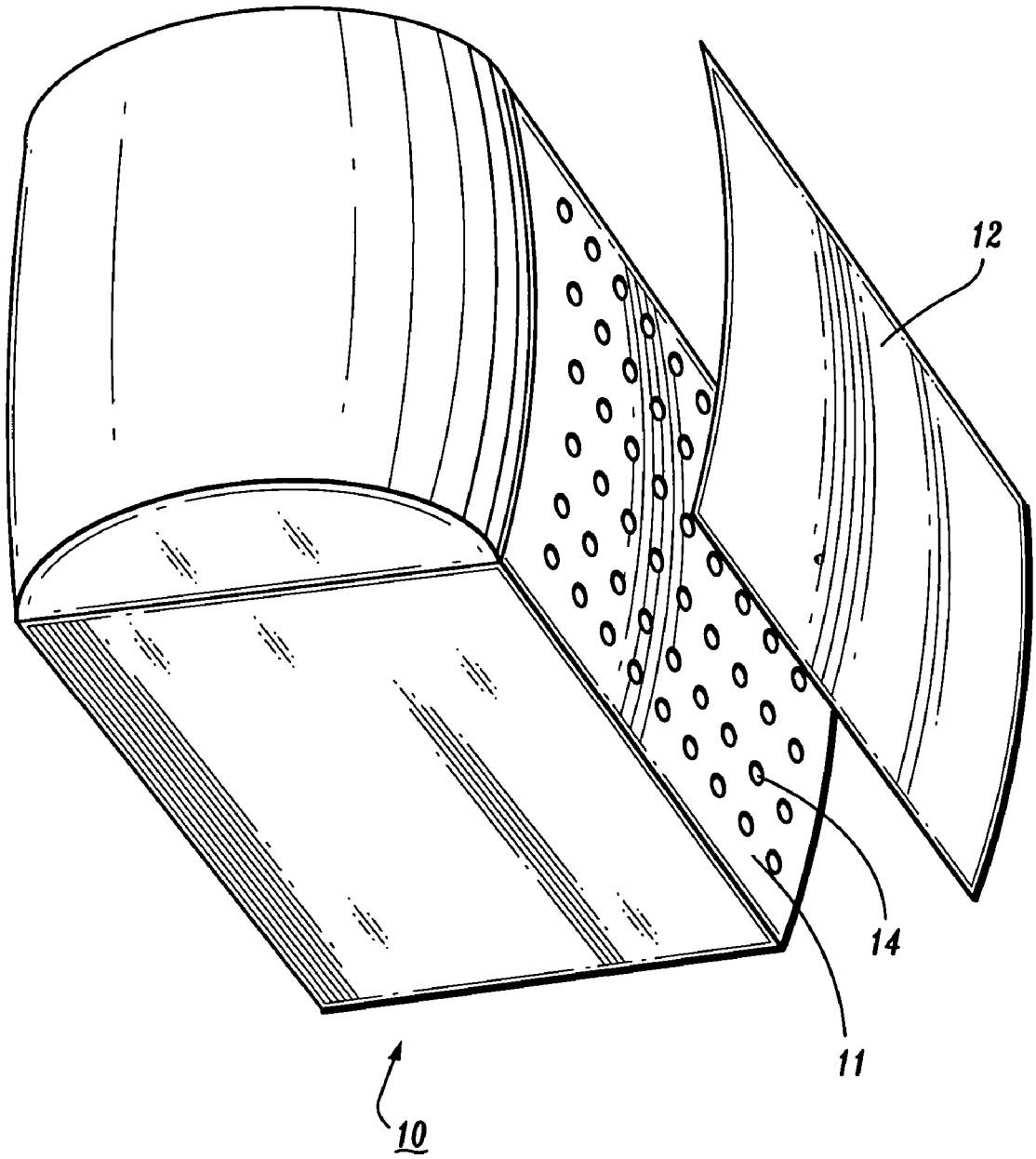
FIG. 1C shows a perspective view of a removable speaker cover including an acoustically transparent portion according to an embodiment of the present invention.

In one embodiment, the acoustically transparent portion 11 includes cloth 12 as shown in FIG. 1C. A grill, perforations, acoustic foam or venting can also be used as the acoustically transparent portion 11. The cloth 12 can also be used in combination with any of the grill, the perforations, acoustic foam and the venting. Referring to FIG. 1B, the acoustically transparent portion 11 can be the grill (a) including openings or holes 18 arranged in a grid, the perforations (b) including openings or holes 14 and the venting (c) including stacked concentric portions 19 spaced apart from each other to form openings or holes therebetween. The acoustically transparent portion may also include one large opening or hole or a relatively small number of openings or holes, which may be larger than the holes 14.

FIG. 1C shows a perspective view of the cover 10 in which the cloth 12 is used in combination with the openings 14 forming the perforations for the acoustically transparent portion 11 according to an embodiment of the present invention. Alternatively, the cloth 12 may be used with the grid or venting or over a large opening or hole formed in the cover 10.

In the alternative, an acoustically modifying portion may be substituted for the acoustically transparent portion. The acoustically modifying portion can be located in the same position as the acoustically transparent portion, but may include different materials or configurations from the acoustically transparent portion to alter output level, directionality and frequency response from the sound producing portion 16. The different materials and configurations are known to those of skill in the art, and may include, for example, grill mesh to attenuate high frequency or variable density foam to change directionality.

It is to be understood that the terms acoustically transparent and acoustically modifying are defined to include substantially acoustically transparent or modifying based on allowable manufacturing tolerances and errors known to one of ordinary skill in the art.

For preventing the cover 10 from being affected by the mechanical vibration or resonation, which can be caused by the speaker 15, the remaining portion of cover 10 can be made from a soundproofing material. Composite foams, a felt type material or other material can be used as the soundproofing material. A sound dampening material may be incorporated into the cover 10 to further reduce the mechanical vibration or resonations. The sound dampening material may include, for example, a water-based sound dampening compound or a self-adhesive sound dampening sheet.

It is to be understood that the terms soundproofing and sound dampening are defined to include substantially soundproofing or sound dampening based on allowable manufacturing tolerances and errors known to one of ordinary skill in the art.

Figure 2:
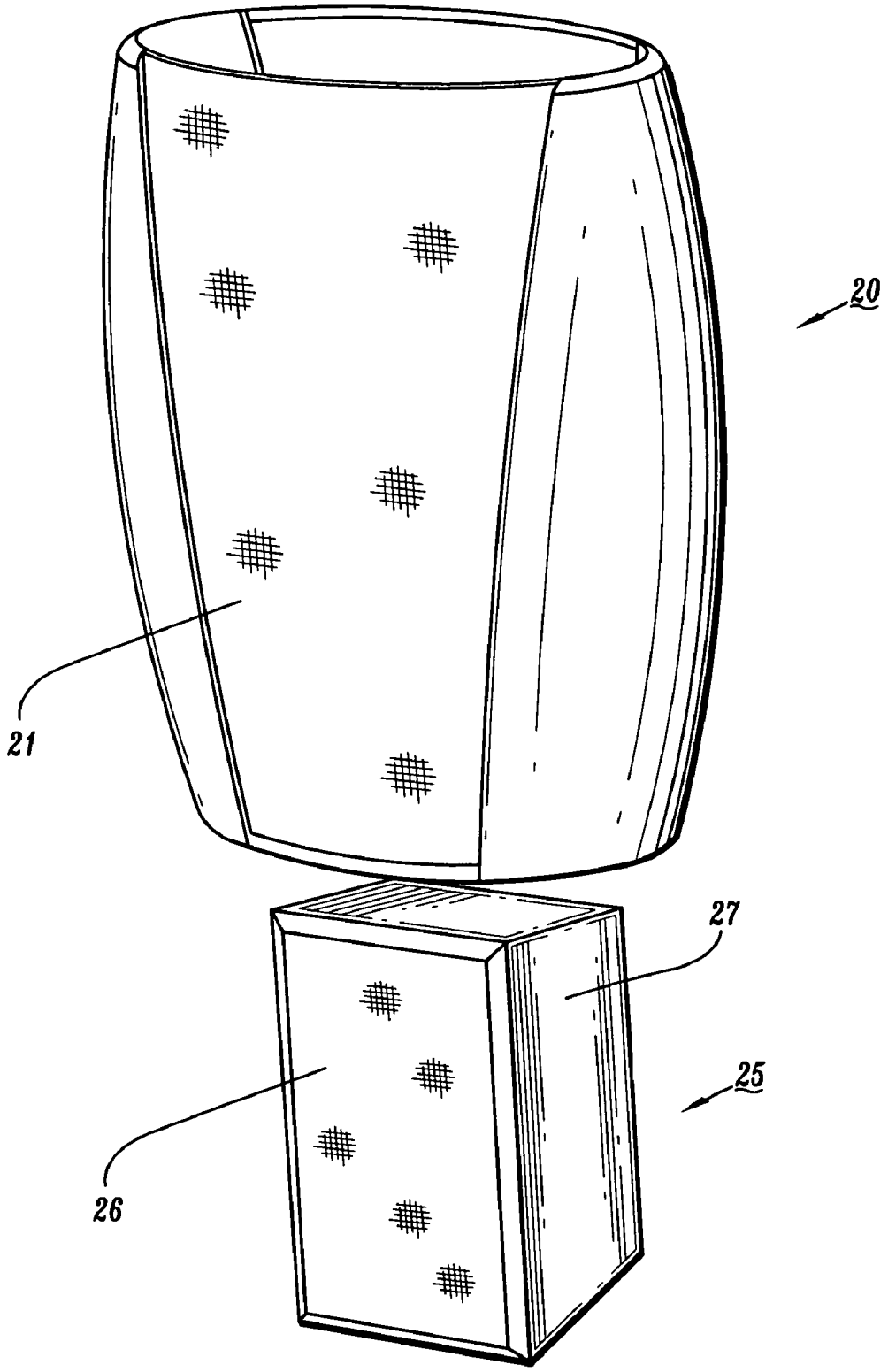
FIG. 2 shows a removable speaker cover according to another exemplary embodiment of the present invention.

FIG. 2 shows a perspective view of a removable speaker cover 20 shaped as a vase according to an exemplary embodiment of the present invention. The bottom portion and top portion of the cover 20 are open and comprise, for example, a circular or oval shape. The speaker 25 enters the cover 20 through the open top or bottom portions. The cover 20 further includes an internal cavity for receiving and enclosing the speaker 25. The speaker 25 comprises a sound producing portion 26 disposed in a housing 27 for projecting acoustic signals. When the housing 27 is placed in the cover 20, the housing 27 is enclosed by the cover 20. The opened top portion and bottom portion of the cover 20 facilitate removal of the cover 20 and also provide a decorative effect of a vase. The cover 20 comprises an acoustically transparent portion 21, like the acoustically transparent portion 11, which is disposed opposite the sound producing portion 26 when the cover 20 covers the speaker 25. Thus, the acoustic signals pass through the cover 20 without significant reduction of sound propagation. Like the cover 10, an acoustically modifying portion may be substituted for the acoustically transparent portion and the remaining portion of the cover 20 can be made from a soundproofing material. A dampening material may be incorporated into the cover 20 to further reduce the mechanical vibration or resonations.

Figure 3A:
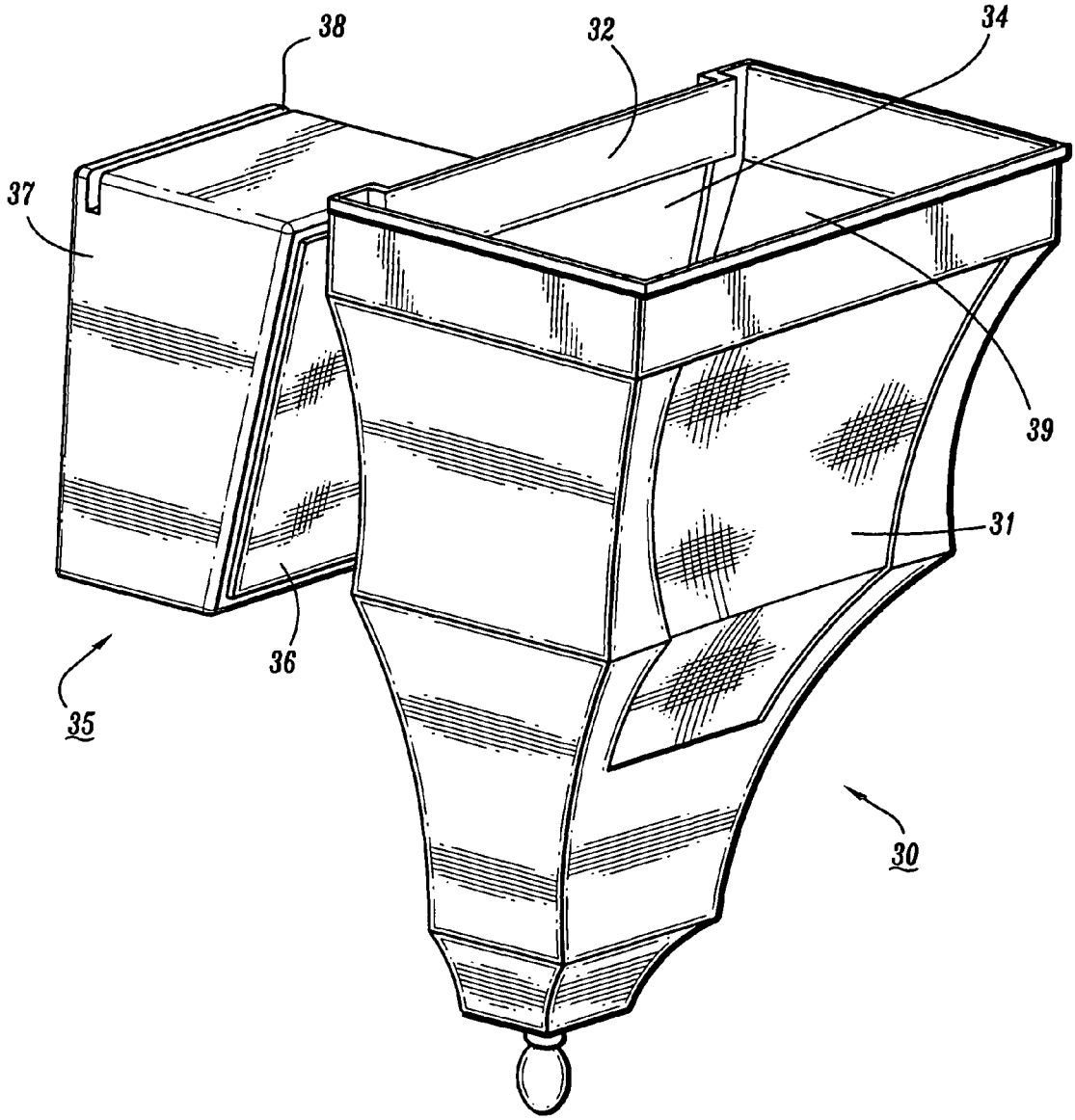
FIG. 3A shows a removable speaker cover according to another exemplary embodiment of the present invention.

FIG. 3A shows a perspective view of a removable speaker cover 30 shaped as a wall sconce according to an exemplary embodiment of the present invention. The cover 30 comprises a first opening 34 on a side of the cover 30 to allow a speaker 35 to enter the cover 30. The speaker 35 is a wall-mounted style speaker. The cover 30 further comprises an acoustically transparent portion 31 like the acoustically transparent portion 11. The cover 30 is placed over the speaker 35 which is preferably already mounted to a wall and an edge part 32 of the cover 30 slides into a groove 38 in the housing 37 of the speaker 35 so that the cover 30 can be readily attached and detached to and from the housing 37 of the speaker 35. The cover 30 further includes an internal cavity for receiving and enclosing the speaker 35. The internal cavity is large enough to enable the cover 30 to rest against the wall to which the speaker 35 is mounted. The acoustically transparent portion 31, like the acoustically transparent portion 11, is formed to be disposed opposite the sound producing portion 36 when the cover 30 covers the speaker 35. The top portion 39 can be open to facilitate placement of the cover 30 on the speaker 35. Like the covers 10 and 20, an acoustically modifying portion may be substituted for the acoustically transparent portion and the remaining portion of the cover 30 can be made from a soundproofing material. A dampening material may be incorporated into the cover 30 to further reduce the mechanical vibration or resonation.

Figure 3B:
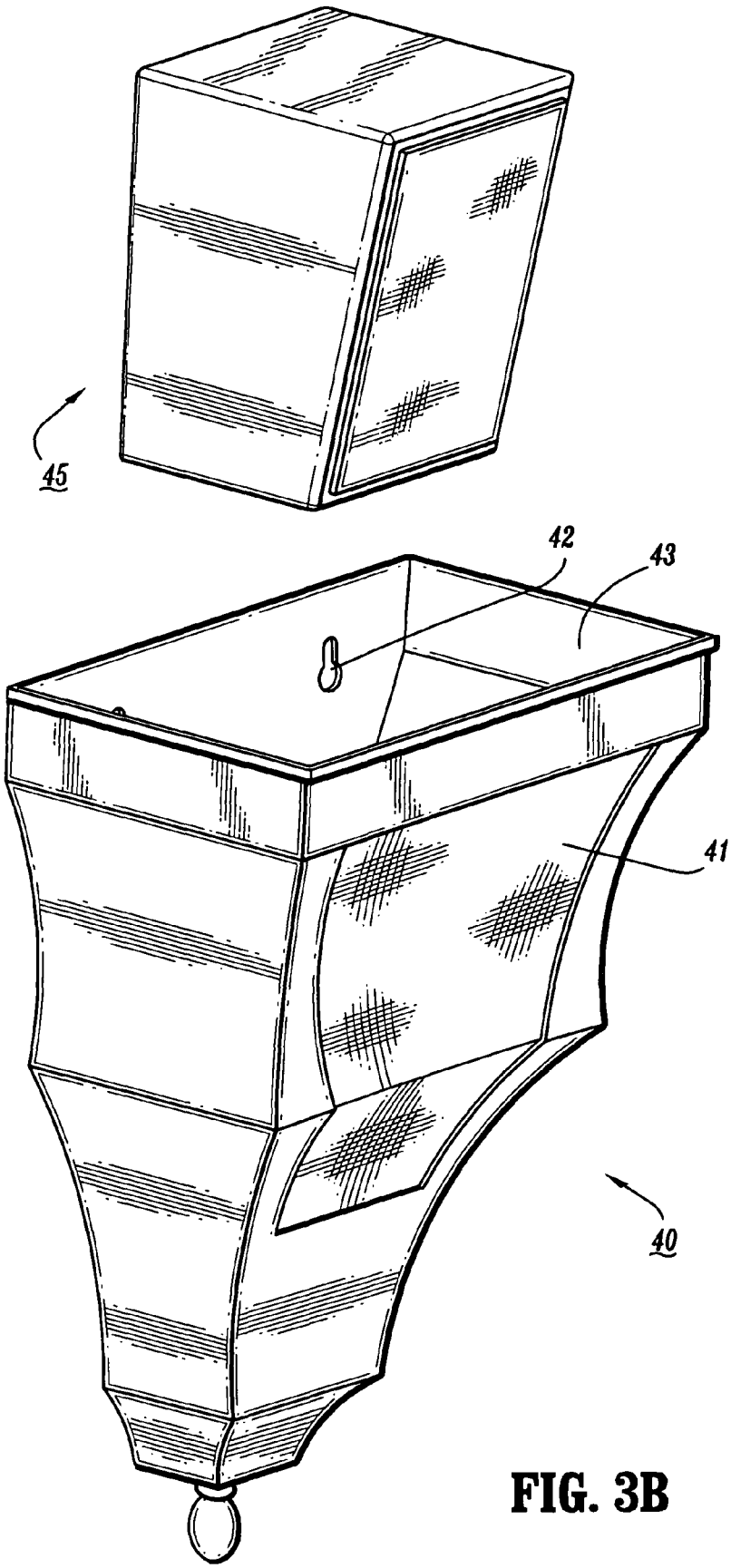
FIG. 3B shows a removable speaker cover according to another exemplary embodiment of the present invention.

FIG. 3B shows a perspective view of a removable speaker cover 40 shaped as a wall sconce according to another exemplary embodiment of the present invention. The cover 40 comprises a first opening 43 to allow a wall-mounted style speaker 45 to enter the cover 40. The cover 40, like cover 30, further includes an internal cavity for receiving and enclosing the speaker 45. The cover 40 further comprises an acoustically transparent portion 41 like the acoustically transparent portion 11.

The cover 40 can be attached and detached to and from a wall using one or more holes 42 for receiving, for example, hooks, screws, or nails (not shown) to be connected to the wall. The speaker 45 can be mounted to the wall using the same hooks, screws or nails that secure the cover 40 to the wall. Alternatively, the speaker 45 can rest inside the cover 40, for example, on a shelf therein, such that the cover 40 supports the speaker 45. Like the covers 10-30, an acoustically modifying portion may be substituted for the acoustically transparent portion and the remaining portion of the cover 40 can be made from a soundproofing material. A dampening material may be incorporated into the cover 40 to further reduce the mechanical vibration or resonation.

Figure 4:
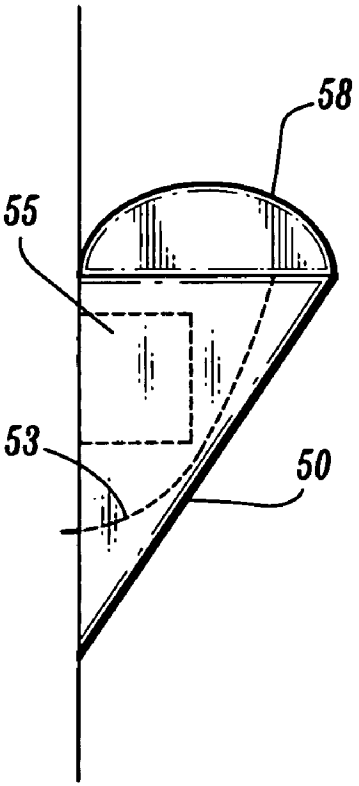
FIG. 4 shows removable speaker covers including a light fixture according to embodiments of the present invention.
Figure 4:
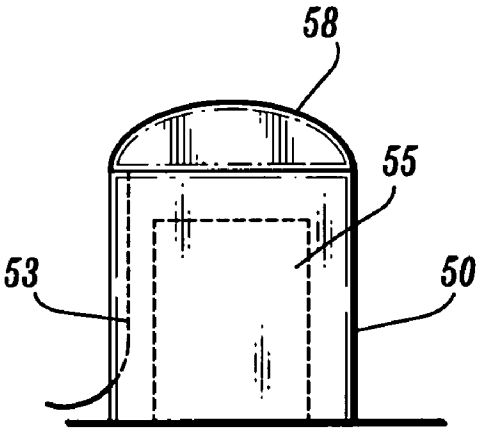
Figure 4:
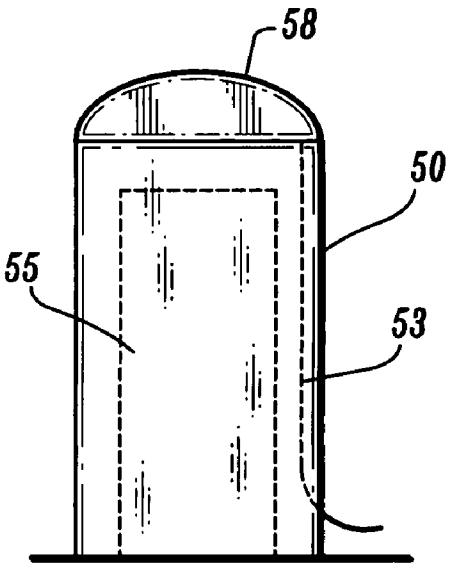

Referring to FIG. 4, a cover 50 can include a light fixture 58. The covers 50 shown in (a)-(c) are the same or similar to the covers 10-40 in that they cover a speaker 55. However, the covers 50 also include the light fixture 58. The light fixture 58 can be, for example, a lamp mounted to the top of the cover 50, wherein power is supplied through a wire 53 running to the exterior of the cover 50. The light fixture 58 may also be battery powered. The addition of the light fixtures 58 results in, for example, a wall lamp, a table lamp, or a floor lamp that is also a speaker cover. Other functional additions to the cover may include a timepiece, storage parts (e.g., a drawer or shelf) or portions to accommodate decorative items such as fake plants.

Figure 5A:
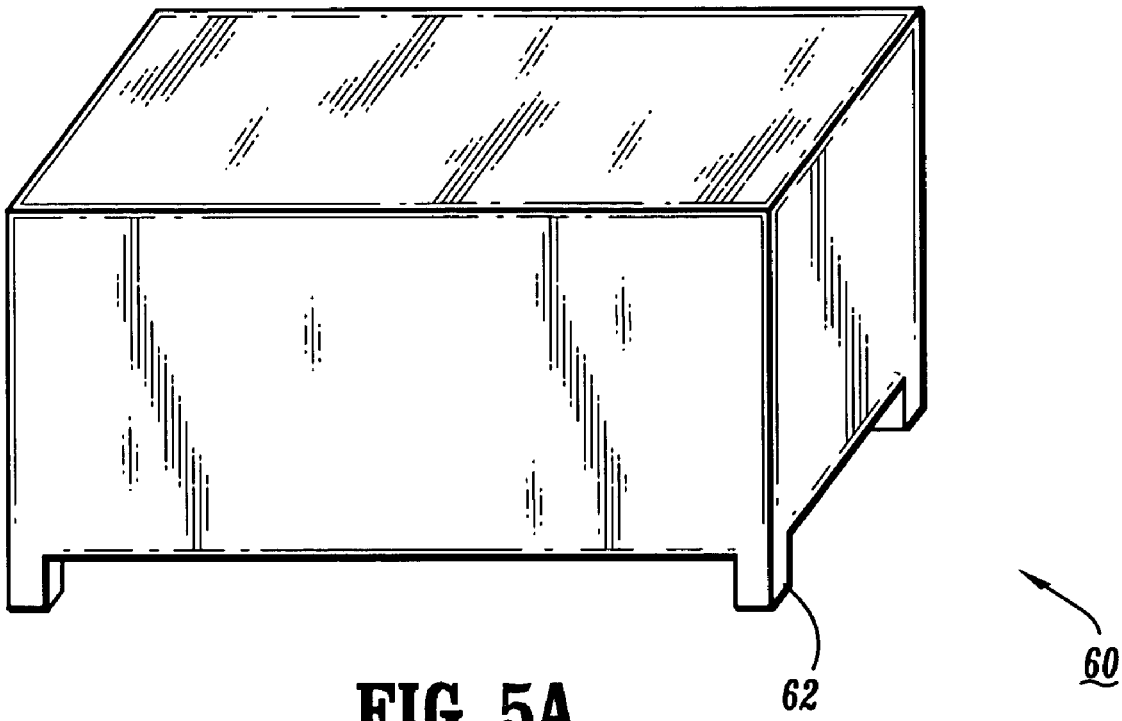
FIGS. 5A-5B show a removable speaker cover according to another exemplary embodiment of the present invention.
Figure 5B:
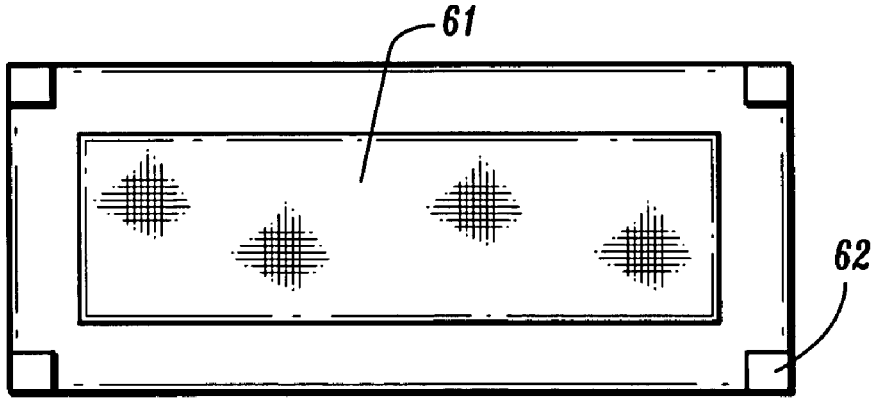

Referring to FIGS. 5A-5B, a cover 60, for example, shaped as a trunk or chest, includes multiple feet or spacers 62 for spacing the cover 60 from a surface on which the cover 60 rests. As shown in FIG. 5B, which is a bottom view of the cover 60, the acoustically transparent portion 61 is located on a bottom side of the cover 60 and is an opening through which the speaker 65 is received and sound propagates. The cover 60 is preferably used with a speaker device 65 having a down-firing driver. Accordingly, the opening and the space formed by the feet 62 allows sound to propagate. The speaker 65 includes a housing 67, which, as shown in FIG. 5A, may be a speaker cabinet.

As in the previous embodiments, the remaining portion of the cover 60 can be made from a soundproofing material and a dampening material may be incorporated into the cover 60 to further reduce the mechanical vibration or resonation.

Figure 6:
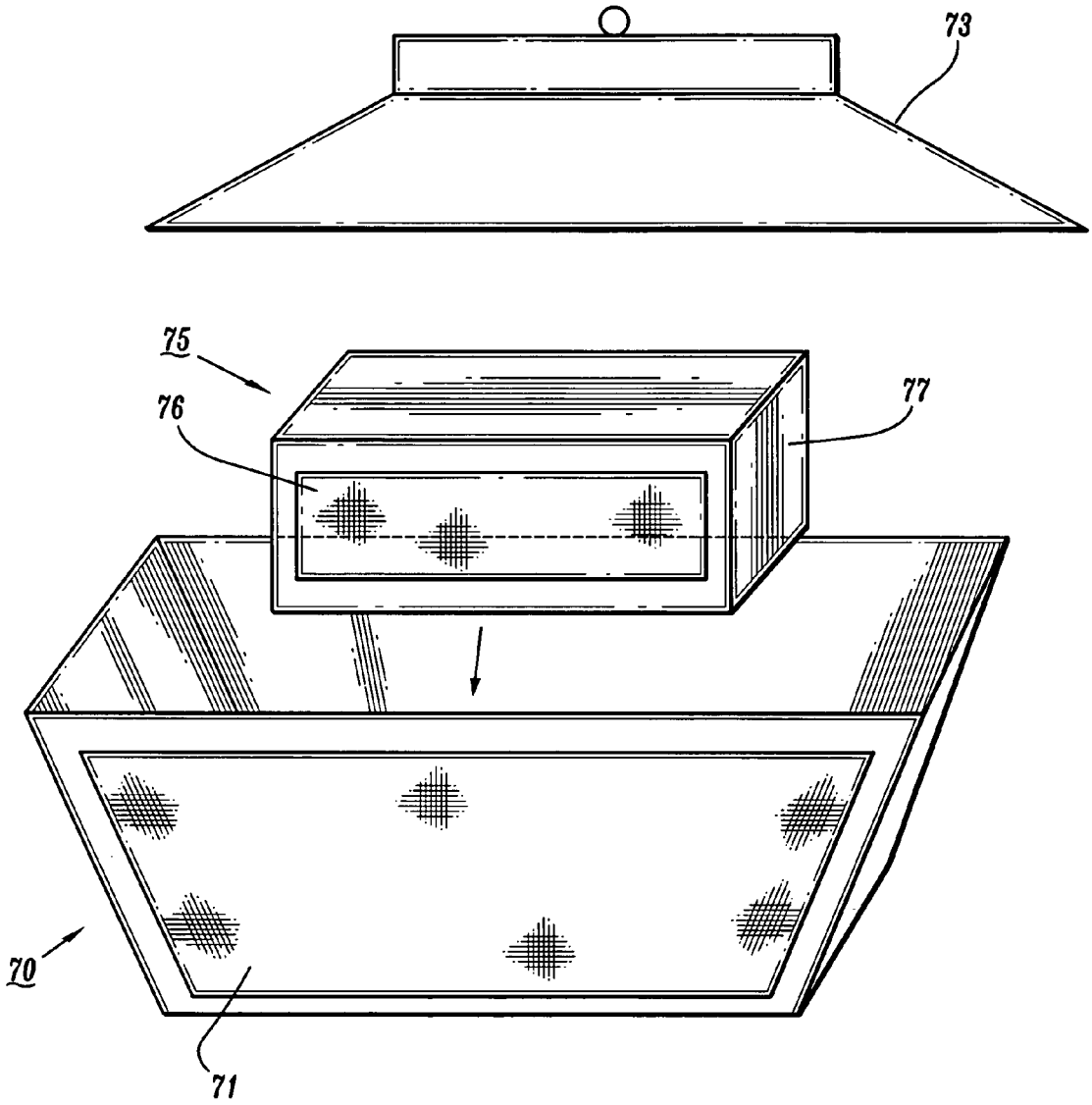
FIG. 6 shows a removable speaker cover according to another exemplary embodiment of the present invention.

Referring to FIG. 6, a cover 70 shaped as a decorative box or container is shown. A speaker 75 is placed in the box 70 through a top opening as shown by the arrow and lowered to the bottom of the box 70. The box 70 can include a lid 73 that rests on top of the box 70. As in previous embodiments, the cover 70 includes an acoustically transparent portion 71 positioned opposite a sound producing portion 76 of the speaker 75 when the speaker 75 is placed in the box 70. As in the previous embodiments, an acoustically modifying portion may be substituted for the acoustically transparent portion and the remaining portion of the cover 70 can be made from a soundproofing material and a dampening material may be incorporated into the cover 70 to further reduce the mechanical vibration or resonation.

In exemplary embodiments of the present invention, any shapes and/or colors of covers can be used. For example, the cover can also be shaped as a decorative column or urn, a bookend, faux books, a clock, a candle holder, or a planter. Furthermore, the surface of the cover may contain an artistic work like a picture, design, custom photograph or print. Also, the covers can include appropriately located holes or openings to accommodate wires leading to and from the speakers.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the present invention.

What is claimed is:

1. A cover for a speaker device having a sound producing portion and a structure for supporting the sound producing portion, the cover comprising:

an opening and an internal cavity for receiving and enclosing the speaker device; and a first portion capable of passing produced sound therethrough, wherein the first portion is formed to be disposed opposite the sound producing portion of the speaker device, wherein the structure for supporting the sound producing portion comprises a speaker cabinet in which the sound producing portion is mounted, and the speaker cabinet sits on a surface and is surrounded by the cover sitting on the same surface as the speaker cabinet, wherein the cover comprises an edge part having a long side extending substantially parallel to a top surface of the speaker cabinet, wherein the edge part fits into a groove formed in and extending along the top surface of the cabinet.

2. The cover of claim 1, wherein the first portion is acoustically transparent.

3. The cover of claim 1, wherein the first portion is acoustically modifying.

4. The cover of claim 1, further comprising a second portion comprising a soundproofing material.

5. The cover of claim 4, wherein the second portion further comprises a sound dampening material.

6. The cover of claim 1, wherein the first portion includes at least one of cloth, a grill, perforations, acoustic foam or venting.

7. The cover of claim 1, wherein the first portion includes at least one opening.

8. The cover of claim 1, wherein the speaker device is one of a subwoofer, a woofer, a full-range, a mid-range, a tweeter or a combination thereof.

9. The cover of claim 1, wherein the cover is shaped as a wall sconce.

10. The cover of claim 1, further comprising a light fixture.

11. The cover of claim 1, further comprising a storage unit.

12. A cover for a speaker device having a sound producing portion and a cabinet for housing the sound producing portion, the cover comprising:

an opening and an internal cavity for receiving and enclosing the speaker device; and a first portion capable of passing produced sound therethrough, wherein the sound producing portion is mounted in the cabinet, the cabinet sits on a surface and the cabinet is surrounded by the cover sitting on the same surface as the cabinet, wherein the cover comprises an edge part having a long side extending substantially parallel to a top surface of the cabinet, wherein the edge part fits into a groove formed in and extending along the top surface of the cabinet.

13. The cover of claim 12, wherein the first portion is formed to be disposed opposite the sound producing portion of the speaker device.

14. The cover of claim 12, further comprising a second portion comprising a soundproofing material.

* * * * *